United States Patent [19]

Watmough

[11] 4,404,262

[45] Sep. 13, 1983

[54] COMPOSITE METALLIC AND REFRACTORY ARTICLE AND METHOD OF MANUFACTURING THE ARTICLE

[75] Inventor: Thomas Watmough, Flossmoor, Ill.

[73] Assignee: International Harvester Co., Chicago, Ill.

[21] Appl. No.: 289,586

[22] Filed: Aug. 3, 1981

[51] Int. Cl.[3] ..... B22F 3/26

[52] U.S. Cl. ..... 428/539.5; 29/156.5 R; 164/98; 164/103

[58] Field of Search ..... 428/539.5; 164/98, 103, 164/105, 120

[56] References Cited

U.S. PATENT DOCUMENTS

| | | | |
|---|---|---|---|
| 3,149,409 | 9/1964 | Maruhn | 29/156.5 R |
| 3,864,154 | 2/1975 | Gazza | 428/539.5 |
| 3,928,662 | 12/1975 | Kaneko | 164/98 |
| 3,939,897 | 2/1976 | Kaneko | 164/103 |
| 4,033,400 | 7/1977 | Gurwell | 164/98 |

*Primary Examiner*—Brooks H. Hunt

*Assistant Examiner*—Anne Brookes

*Attorney, Agent, or Firm*—Boris Parad; F. David AuBuchon

[57] ABSTRACT

A composite metallic and refractory article and a method for manufacturing the article is described in which a metallic layer is partially adsorbed within a refractory layer, such as a ceramic layer. The density of the refractory layer increases as it extends away from the metallic layer. The composite is formed by forcing a molten metal under pressure into the pore structure of the refractory layer. Conveniently, a desired internal shape of the finished product is achieved by using a male mold portion to supply the required pressure and to simultaneously form the article having a desired internal cavity. The application of pressure continues long enough to allow the molten metal to become sufficiently adsorbed within the porous refractory layer. When the composite solidifies, the male mold portion is withdrawn from the finished article. In one embodiment the article formed is a piston having a heat resistant ceramic cap combined with an aluminum body.

1 Claim, 8 Drawing Figures

COMPOSITE METALLIC AND REFRACTORY ARTICLE AND METHOD OF MANUFACTURING THE ARTICLE

BACKGROUND OF THE INVENTION

1. Field of the Invention

This invention relates generally to composite articles of metal and ceramic and to methods of forming such articles. Specifically, the invention relates to composite metal and ceramic articles useful as heat resistant structures in internal combustion engines.

2. Background Art

The desirability of combining the heat resistance of ceramic with the workability and durability of a metal has long been recognized. For example, a variety of efforts have been directed in the past to forming a ceramic layer on the surface of metallic parts used in internal combustion engines. One of the first attempts to achieve a ceramic coated automotive part is described in U.S. Pat. Nos. 1,462,655 and 1,490,849 to Philip wherein a ceramic disc is entrapped within a metallic cap to form a piston. The cap and disc are then placed in a mold which is filled with molten iron or other metal so that the iron adheres to the metallic cap placed around the ceramic disc. It was found that the ceramic disc did not absorb heat and therefore the collection of hydrocarbon particles on the piston was decreased. U.S. Pat. Nos. 3,777,722, 4,142,500 and 2,657,961 also suggest ceramic coated metals for use in automotive applications.

Still others have disclosed methods for producing engine parts wherein ceramic particles are forced into the surface of a heated metallic automotive part. The result is a superficial ceramic-metal surface which partially insulates the adjacent all metallic portion, as described in U.S. Pat. Nos. 2,075,388 and 3,149,409. While these patents evidence a significant advance in the art, applicant has recognized that the bonding of the ceramic particles to the metal part is less than optimal in a number of aspects. Firstly, the integrity of the bond is questionable in that the ceramic particles may tend to coalesce, overlap, or clump together when injected into the molten metal. Since the coalesced particles are not totally surrounded by metal, the strength of the metal to ceramic bond is diminished such that the coalesced particles may break loose resulting in surface scalling, cracking, or pitting especially when exposed to high temperatures. Secondly, the resulting composite surface is partially made up of metal and partially of ceramic so that a heat transfer path to the metallic part still exists from the high temperature environment. Since the exposed metallic portion conducts heat quickly to the remainder of the part, the full benefits from combining the ceramic and metallic portions are not fully achieved.

SUMMARY OF THE INVENTION

It is an object of the present invention to provide a composite refractory and metallic article and method for forming the article which overcome many of the disadvantages of the prior art.

It is still another object of the present invention to provide such an article and method for forming the article which enables the part to be made at low cost while achieving a strong bond between the ceramic and the metallic portions.

It is yet another object of the present invention to provide such an article wherein the refractory portion is capable of thermally insulating the metallic portion from a heat source.

It is still another object of the present invention to provide composite ceramic-metal articles for use in internal combustion engines having high strength, temperature and thermal shock capabilities.

It is also an object of the present invention to provide composite ceramic-metal articles for use in high temperature environments which resist oxidation and pitting of exposed surfaces.

It is yet another object of the present invention to provide a composite ceramic and metallic article in which the ceramic article is held by compression bonding to a metallic base.

It is still another object of the present invention to provide an article and method for forming the article in which the degree of infiltration of the metal into the ceramic and thus the nature of the bond between the two can be selectively controlled.

These and many other objects and advantages of the present invention are achieved by a method of forming a composite article. The method includes the steps of disposing a refractory material, such as a ceramic member, having surfaces of different porosity in contact with a molten metal, and forcing the molten metal into a surface of the ceramic member. The molten metal is allowed to solidify within the pore structure of the ceramic forming a solid composite having an exposed surface composed entirely of ceramic.

These objects and advantages are also achieved by a composite article having a metallic portion and a ceramic portion connected to the metallic portion. The ceramic portion has a heat resistant surface of lesser porosity than the region of the ceramic portion in contact with the metallic portion. The metallic portion is adsorbed into the ceramic portion.

DETAILED DESCRIPTION OF THE PREFERRED EMBODIMENT

Figure 1:
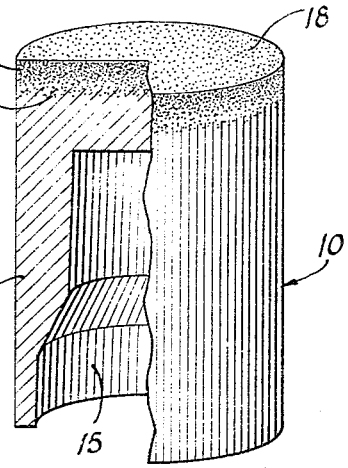
FIG. 1 is a cut-away perspective view of an article in accordance with the present invention.

Referring to the drawing wherein like reference characters are used for like parts throughout the several views, a composite refractory and metallic article 10 is shown in FIG. 1. The article 10, illustrated as a piston for an internal combustion engine, such as a diesel engine, includes a refractory cap 12, preferrably made of a ceramic material, and a metallic base 14. The piston base 14 may be made of a lightweight non-ferrous metal, such as aluminum having lower temperature resistance than that possessed by conventional steel automotive parts such as pistons because of the heat resistance properties of the ceramic cap 12, as explained more fully hereinafter. Similarly, lightweight less expensive alloys may be used as the base 14. The interior of the base 14 is conveniently hollow, as shown at 15, to receive a piston rod, not shown.

The composition and density of the refractory material used in forming the cap 12 depends to a large extent on the requirements of the particular application. Generally, the cap 12 is of a porosity which increases either continuously or discontinuously, being marked by interuptions, or voids from a metal-contacting surface 16 to an exposed refractory surface 18. This arrangement results in a composite article that is capable of relatively ready adsorption of molten metal at the metal-contacting surface 16 while possessing high resistance to heat transfer across the cap 12 from the exposed refractory surface 18 to the metal contacting surface 16.

In accordance with one important embodiment of the present invention, the cap 12 is made of conventional graded density ceramic. To achieve the full advantage of the present invention, the exposed, outward facing surface 18 of the cap 12 is of highest density and lowest porosity, such that the porosity of the cap 12 increases generally continuously while the density of the cap 12 decreases generally continuously from the exposed surface 18 to the metal-contacting surface 16. A variety of conventional ceramics may be used including high density alumina, sintered silicon carbide, hot pressed and sintered silicon nitride, or any other refractory material having the strength and thermal expansion properties required for the particular intended use of the composite article.

In another embodiment, two or more distinct refractory layers are combined to achieve a cap 12 having the desired properties of overall density, density gradient, thermal expansion, and thermal conductivity. Each of the layers used may be made of graded density refractory materials, preferably ceramic materials disposed in overlapping arrangement such that the combined overlapping refractory materials increase in porosity and decrease in density from the exposed surface 18 to the metal-contacting surface 16. The distinct layers of refractory material forming the cap 12 may each be of constant porosity with the metal-contacting layer having a lower porosity than the layer forming the exposed surface 18, the layers being structurally secured together as known in the art. It is preferred that any intermediate layers have a porosity higher than the metal-contacting layer and lower than the layer forming the exposed surface 18 to form a cap 12 having a generally increasing, although discontinuous, porosity from the exposed surface 18 to the metal-contacting surface 16. In one example, the layer forming the surface 18 is made up of silicon nitride while a less expensive material, such as alumina, is used between this layer and the base 14.

Figure 2:
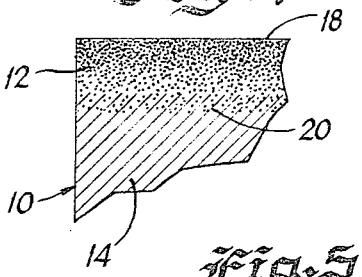
FIG. 2 is an enlarged, partial, cross-sectional view of the article shown in FIG. 1.

An interface 20 between the cap 12 and the base 14, shown schematically in FIG. 2, is made up of the porous refractory, i.e. ceramic, structure infiltrated or adsorbed with the chosen metal. The degree of the adsorption of the metal into the ceramic interface surface 16 may be controlled by varying the porosity gradient from the metal-contacting surface 16 to the exposed surface 18 as well as by varying the techniques of combining the metal and refractory materials, as described hereinafter. In accordance with an important embodiment of the present invention, the exposed surface 18 is made up solely of refractory material to form a heat barrier between the exposed surface 18 and the base 14. In this manner, the thickness of the solely refractory region, non-infiltrated at the exposed surface 18, can be made sufficiently thick to adequately protect the metallic base 14 from heat damage.

Figure 3:
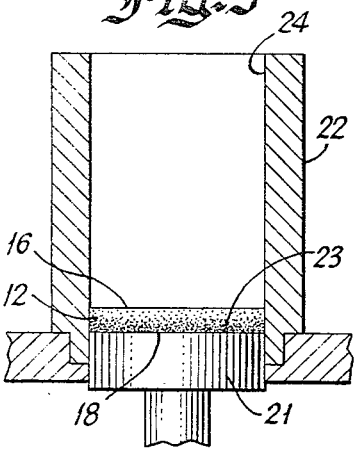
FIGS. 3 through 8 are reduced, partial cross-sectional views illustrating the method and apparatus for forming the article shown in FIG. 1.

As shown in FIGS. 3 through 8, the article 10 is preferably formed by forcing a molten metal into the porous metal-contacting surface 16 of the ceramic cap 12. This is conveniently accomplished by positioning the cap 12 on a vertically moveable ejection punch 21 having a top surface 23 that forms a base of a cylindrical female mold portion 22 shaped to conform to the shape of the cap 12, as shown in FIG. 3. The ejection punch 21 supports the cap 12 and is vertically movable within a cylindrical bore 24 of the female mold portion 22 to eject the finished composite product through a top of the female mold portion 22. The cap 12 is arranged with the metal-contacting surface 16 of greater porosity facing upwardly, temporarily exposed, and the surface 18 resting atop the punch 24 so that the article 10 is made in a configuration upside down from that illustrated in FIG. 1.

Figure 4:
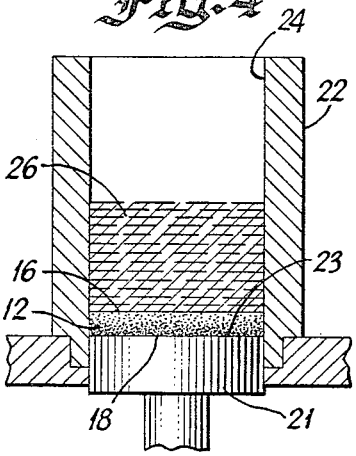

The porous metal-contacting surface 16 of the cap 12 is infiltrated with the molten metallic material 26 which is poured into the female mold portion 22 through its open top, as shown in FIG. 4. The cap 12 may be heated by a heater (not shown) either located within the female mold portion 22 or disposed externally of it. The temperature of the cap 12 affects the extent of adsorption of the metal into the cap 12, generally the higher the cap temperature the greater the adsorption.

Figure 5:
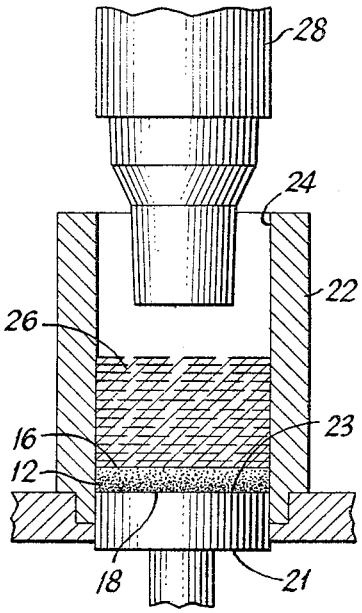
Figure 6:
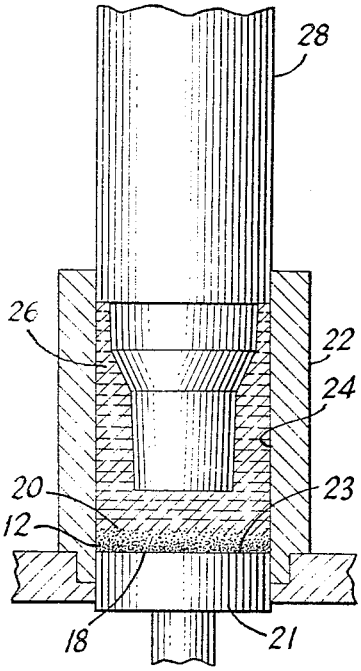

An appropriately shaped, mating male mold portion 28 is then lowered into the female mold portion 22 from the position shown in FIG. 5 to the position shown in FIG. 6 causing the molten metal 26 to conform to the exterior shape of the male mold portion 28. Preferably, the shape of the male mold portion 28 is chosen to provide the desired internal shape of the part to be formed. For example, when forming a piston, as illustrated in the drawings, the male mold portion conveniently is shaped to provide the cavity 15 having a desired shape to accomodate a complementary shaped piston rod, not shown. Considerable pressure is applied by the male mold portion 28 to cause the metal 26 to conform to the shape of the male mold portion 28 and to force the molten metal into the porous structure of the cap 12. This also assures that no shrinkage cavities are formed within the metallic base 14. In accordance with an important embodiment of the present invention, the applied pressure is from about 140 to about 1400 kilograms per square centimeter. The optimal pressure value depends upon the pouring temperature of the metal used, the design of the part, the porosity of the ceramic cap 12, the depth of infiltration desired in the cap 12, and the temperature of the cap 12, and can easily be determined in practice.

Figure 7:
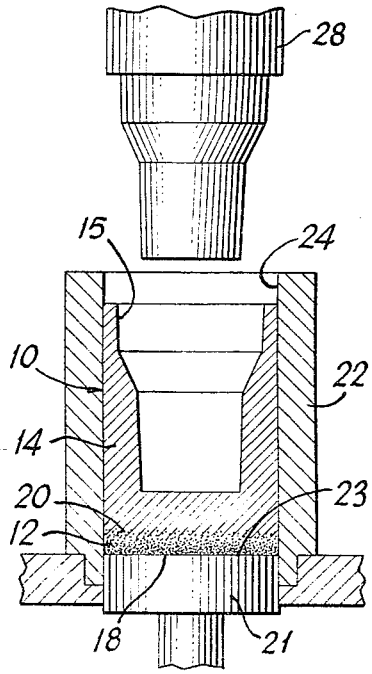
Figure 8:
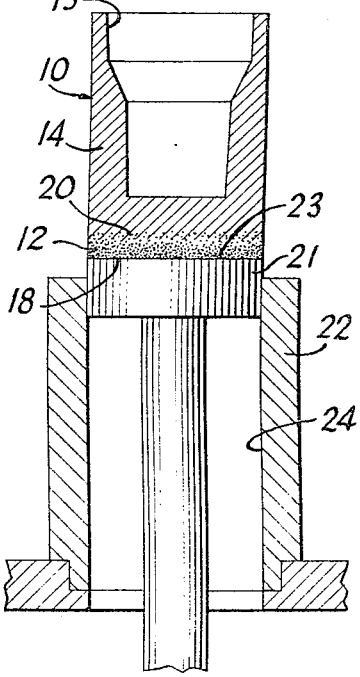

When the metal has solidified, the male mold portion 28 is withdrawn, as shown in FIG. 7, and the finished article 10 is ejected by vertically raising the ejection punch 21, as shown in FIG. 8. In the finished article 10, the metal base 14 is securely adhered to the cap 12 through the adsorption of the liquid metal into the pore structure of the cap 12 at the metal-contacting surface 16 and within the cap 12 at least 0.005 inch to assure an adequate bond so that the cap 12 does not shear away or delaminate from the base 14 during use of the composite article 10.

Through the appropriate choice of material for the base 14 and the cap 12, the base 14 can be caused to compressively grip the cap 12. Where the metal forming the base 14 has a substantially higher coefficient of thermal expansion than the refractory forming the cap 12, the shrinkage of the metal upon hardening places the cap 12 in compression to an extent dependent upon the type of ceramic, the types of metal used, the temperature of the cap, and the design of the cap. In accordance with one important embodiment of the present invention, the metal and refractory materials are chosen such that the metal has a coefficient of thermal expansion at least twice that of the refractory material so that the metal tenaciously grips the cap 12. In one preferred embodiment of the present invention, aluminum having a coefficient of thermal expansion of approximately 23.5 microinches per inch per degree centigrade forms the metallic base 14, and the cap 12 is made of high density alumina having a coefficient of thermal expansion of about 7.7 microinches per inch per degree centigrade together with silicon nitride with a coefficient of thermal expansion of about 3.7 microinches per inch per degree centigrade. The more rapid contraction of the aluminum upon cooling after infiltration into the ceramic cap 12 results in tenacious compressive gripping of the refractory cap 12 by the metallic base 14. This produces a very strong bond between the cap 12 and the base 14.

While there has been illustrated and described a limited number of embodiments of the present invention, it will be apparent that various changes and modifications thereof will occur to those skilled in the art. It is intended in the appended claims to cover all such changes and modifications as fall within the true spirit and scope of the present invention.

What is claimed as new and desired to be secured by Letters Patent of the United States is:

1. A method of manufacturing a composite article comprising a metallic portion and a refractory portion bonded together comprising:

disposing a first refractory member in contact with a molten metal, said refractory member having a predetermined thickness of a first solid refractory material extending from an exposed surface of said refractory member to define a refractory-metal interface within said refractory member, said refractory member including a second, porous refractory material extending from said refractory-metal interface to a metal contacting surface of said refractory member, where said second, porous refractory material has a porosity gradient generally increasing from said refractory-metal interface to said metal contacting surface and where the metal has a coefficient of thermal expansion at least twice the coefficient of thermal expansion of said second refractory material;

securing a second, distinct porous refractory member to said first refractory member, said second refractory member having a greater porosity than said second refractory material of said first refractory member;

applying a force between 140 and 1400 kilograms per square centimeter to said molten metal to cause said molten metal to penetrate through said second more porous refractory member and into said second, porous refractory material of said first refractory member; and solidifying said molten metal.

* * * * *